US012385707B2

(12) United States Patent
Lee et al.

(10) Patent No.: US 12,385,707 B2
(45) Date of Patent: Aug. 12, 2025

(54) MODULAR TRIGGER CONTROL UNIT FOR FIREARMS

(71) Applicant: Strike IP, LLC, Las Vegas, NV (US)

(72) Inventors: Shanyao Lee, Las Vegas, NV (US); David Hyung Chin, Las Vegas, NV (US)

(73) Assignee: Strike IP, LLC, Las Vegas, NV (US)

( * ) Notice: Subject to any disclaimer, the term of this patent is extended or adjusted under 35 U.S.C. 154(b) by 0 days.

(21) Appl. No.: 18/603,177

(22) Filed: Mar. 12, 2024

(65) Prior Publication Data

US 2024/0410666 A1 Dec. 12, 2024

Related U.S. Application Data

(63) Continuation-in-part of application No. 17/752,794, filed on May 24, 2022, now Pat. No. 12,044,494, which is a continuation-in-part of application No. 17/100,156, filed on Nov. 20, 2020, now Pat. No. 11,385,011, which is a continuation-in-part of application No. 16/726,923, filed on Dec. 25, 2019, now Pat. No. 10,876,806, which is a continuation-in-part of application No. 16/718,825, filed on Dec. 18, 2019, now Pat. No. 10,837,727.

(60) Provisional application No. 62/781,238, filed on Dec. 18, 2018.

(51) Int. Cl.
*F41A 19/15* (2006.01)
*F41A 19/31* (2006.01)

(52) U.S. Cl.
CPC ..... *F41A 19/15* (2013.01); *F41A 19/31* (2013.01)

(58) Field of Classification Search
CPC ..... F41A 19/15; F41A 19/31
See application file for complete search history.

(56) References Cited

U.S. PATENT DOCUMENTS

| | | | | |
|---|---|---|---|---|
| 10,119,777 | B2 * | 11/2018 | Wolf | F41A 11/02 |
| 10,429,143 | B2 * | 10/2019 | Zajk | F41C 3/00 |
| 10,794,646 | B2 * | 10/2020 | Fellows | F41A 3/66 |
| 10,837,727 | B2 * | 11/2020 | Lee | F41A 19/32 |
| 10,876,806 | B2 * | 12/2020 | Lee | F41A 19/10 |
| 11,385,011 | B2 * | 7/2022 | Lee | F41A 19/12 |
| 11,525,645 | B2 * | 12/2022 | Wolf | F41A 11/02 |
| 2009/0071053 | A1 * | 3/2009 | Thomele | F41A 11/02 42/70.08 |

* cited by examiner

*Primary Examiner* — Michelle Clement
(74) *Attorney, Agent, or Firm* — Andy M. Han; Han IP PLLC

(57) ABSTRACT

A modular trigger control unit Is configured to be removably installed on a grip frame of a firearm and includes a locking block and a pin configured to traverse through both the trigger control unit and the grip frame. The trigger control unit has a protruding tab protruding rearward. The locking block includes slide rails extending forward, with each slide rail of the pair of slide rails having a flat wall extending downward or upward with respect to the grip frame when the trigger control unit is installed on the grip frame. The trigger control unit is secured to the grip frame by: (1) the protruding tab received in a recess on an interior wall of a beavertail portion of the grip frame; (2) the pin; and (3) one or more first physical features on the trigger control unit mating with one or more second physical features on the grip frame.

20 Claims, 17 Drawing Sheets

MODULAR TRIGGER CONTROL UNIT FOR FIREARMS

CROSS REFERENCE TO RELATED PATENT APPLICATION(S)

The present disclosure is part of a continuation-in-part (CIP) of U.S. patent application Ser. No. 17/752,794, filed on 24 May 2022, which is a CIP of U.S. patent application Ser. No. 17/100,156, filed on 20 Nov. 2020 and issued as U.S. Pat. No. 11,385,011 on 12 Jul. 2022, which is a CIP of U.S. patent application Ser. No. 16/726,923, filed on 25 Dec. 2019 and issued as U.S. Pat. No. 10,876,806 on 29 Dec. 2020, which is a CIP of U.S. patent application Ser. No. 16/718,825, filed on 18 Dec. 2019 and issued as U.S. Pat. No. 10,837,727 on 17 Nov. 2020, which claims the priority benefit of U.S. Provisional Patent Application No. 62/781,238, filed on 18 Dec. 2018. Contents of aforementioned applications are incorporated by reference in their entirety.

TECHNICAL FIELD

The present disclosure is generally related to firearms and, more particularly, to a modular trigger control unit for firearms.

BACKGROUND

Unless otherwise indicated herein, approaches described in this section are not prior art to the claims listed below and are not admitted as prior art by inclusion in this section.

To enhance customization of firearms, modular systems have been introduced to the market for rifles, carbines and pistols alike. However, for pistols such as semi-automatic pistols, currently available modular systems are proprietary in that a fire control unit of a given vendor is designed to function only with proprietary grip frames and slide assemblies.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

An objective of the present disclosure is to provide a modular trigger control unit that can be installed on and function with a plurality of grip frames and slide assemblies of different sizes, colors and/or calibers to form a semi-automatic or full-automatic (e.g., striker-fired) firearm. With the identification marking of the firearm is displayed on the trigger control unit, the modular trigger control unit enables firearm customization by a user.

In one aspect, an apparatus (e.g., a semi-automatic or full-automatic firearm) may include a trigger control unit configured to be removably installed on a grip frame of a firearm. The trigger control unit may include a locking block and a pin configured to traverse through both the trigger control unit and the grip frame. The trigger control unit may have a protruding tab protruding rearward with respect to the firearm. The locking block may include a pair of slide rails extending forward with respect to the firearm, with each slide rail of the pair of slide rails having a flat wall extending downward or upward with respect to the grip frame when the trigger control unit is installed on the grip frame. Accordingly, the trigger control unit may be secured to the grip frame by: (1) the protruding tab received in a recess on an interior wall of a beavertail portion of the grip frame; (2) the pin; and (3) one or more first physical features on the trigger control unit mating with one or more second physical features on the grip frame.

In another aspect, an apparatus (e.g., a semi-automatic or full-automatic firearm) may include a trigger control unit configured to be removably received in a grip frame of a firearm and installed between the grip frame and a slide assembly of the firearm such that, when activated, the trigger control unit causes firing of one or more rounds of ammunition. The trigger control unit may include a trigger mechanism housing, a trigger pin, a trigger pivotable around the trigger pin when pulled, a trigger bar coupled between the trigger and the trigger mechanism housing, a locking block, a locking block pin, and a support frame having a first distal end and a second distal end opposite the first distal end such that the first distal end faces a front side of the grip frame and the second distal end faces a back side of the grip frame when the trigger control unit is installed on the grip frame. The locking block may include a pair of slide rails extending forward with respect to the trigger and the firearm, with each slide rail of the pair of slide rails having a flat wall extending downward or upward with respect to the grip frame when the trigger control unit is installed on the grip frame. Accordingly, the trigger control unit may be secured to the grip frame by: (1) either or both of the locking block pin and the trigger pin, and (2) one or more first physical features on the trigger control unit mating with one or more second physical features on the grip frame.

It is noteworthy that, although description provided herein may be in the context of certain type of semi-automatic or full-automatic firearms such as a striker-fired pistol, the proposed concepts, schemes and any variation(s)/derivative(s) thereof may be implemented in, for and by other types of firearms such as, for example and without limitation, hammer-fired semi-automatic pistols, other semi-automatic firearms and automatic firearms. Thus, the scope of the present disclosure is not limited to the examples described herein.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

Overview

Under various proposed schemes in accordance with the present disclosure, a portable trigger control unit offers modularity and a great degree of customization of firearms such as, for example, semi-automatic or full-automatic pistols. The trigger control unit may be utilized with different grip frames of different sizes and/or colors as well as different slide assemblies of different sizes, colors and/or calibers. It is noteworthy that, although examples in the present disclosure are provided in the context of a striker-fired pistol, the proposed schemes in accordance with the present disclosure may be implemented in different types of firearms (e.g., hammer-fired pistols or semi-automatic rifles and carbines).

Illustrative Implementations

Figure 1:
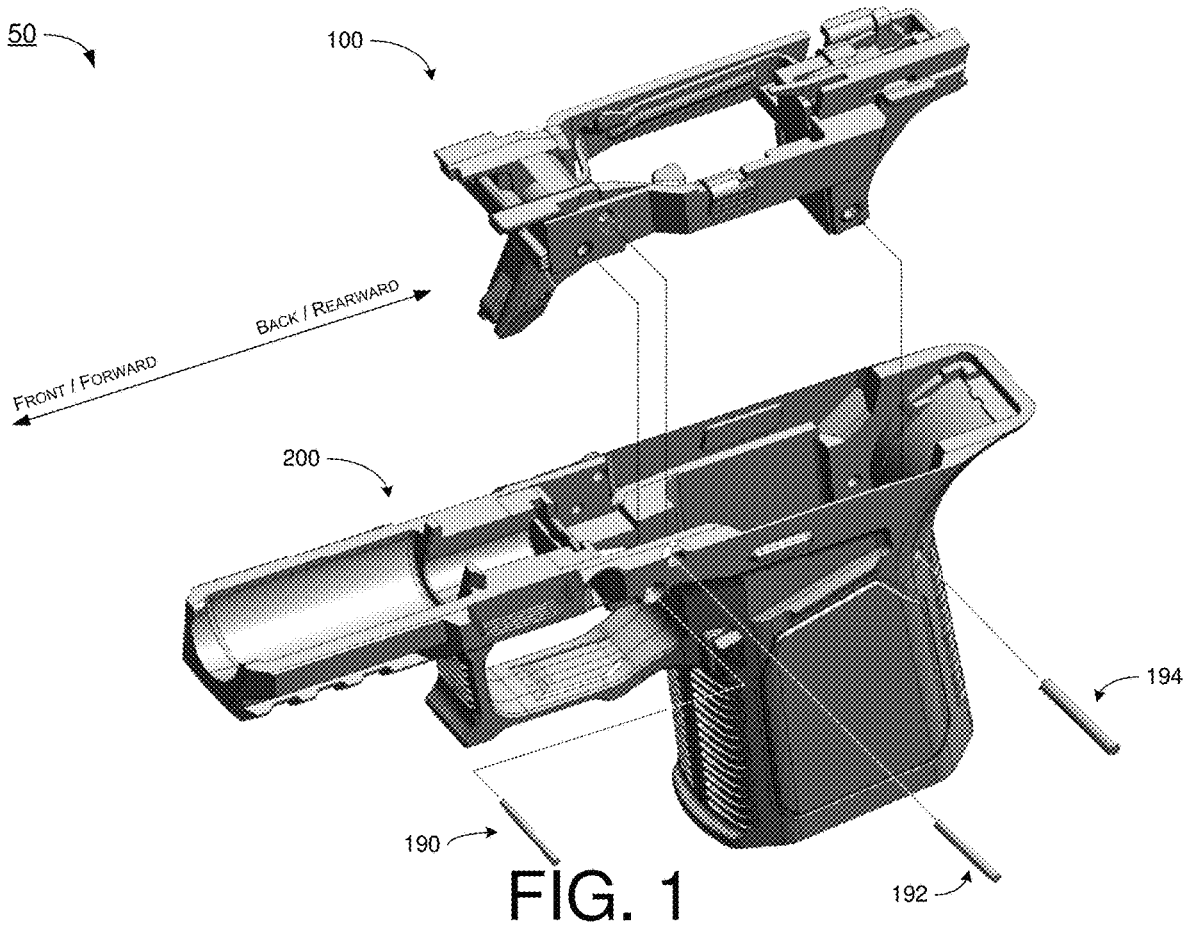
FIG. 1 is a diagram of an exploded view of some of the components of a firearm in accordance with an implementation of the present disclosure.

FIG. 1 illustrates some of the components of a firearm 50 in accordance with an implementation of the present disclosure. Referring to FIG. 1, firearm 50 may include a portable firing control unit or trigger control unit 100 and a grip frame 200. Under the proposed schemes, an identification marking of firearm 50 may be displayed on a portion (e.g., right side or left side) of trigger control unit 100 so that, when the trigger control unit 100 is received, mounted, seated or otherwise installed in a hollow of grip frame 200 the identification marking of firearm 50 may be visible through a cutout or opening on grip frame 200 on the same side (e.g., right side or left side) of trigger control unit 100 where the identification marking is displayed. Grip frame 200 may be made of a polymeric material. Alternatively, grip frame 200 may be made of metal or a composite of metal and polymer. Firearm 50, or trigger control unit 100, may also include a trigger pin 190, a locking block pin 192 and a trigger housing pin 194.

Trigger control unit 100 may be removably installed on or otherwise removably received in grip frame 200. Accordingly, at any given time, a user may install the same trigger control unit 100 in one of different grip frames of different or same colors or for different or same calibers. For instance, a user may install the same trigger control unit 100 in a grip frame in black color for a pistol chambered in 9 mm caliber, in a grip frame in flat dark earth (FDE) color for another pistol chambered in 9 mm (or 40S&W or 357 Sig) caliber, or in a grip frame for a pistol chambered in 45ACP (or 10 mm) caliber.

Trigger control unit 100 may be secured to grip frame 200 at least by trigger pin 190 such that removal of trigger control unit 100 from grip frame 200 would require removal of trigger pin 190 first. In some cases, trigger control unit 100 may also be secured to grip frame 200 by trigger housing pin 194 and/or locking block pin 192.

Figure 2:
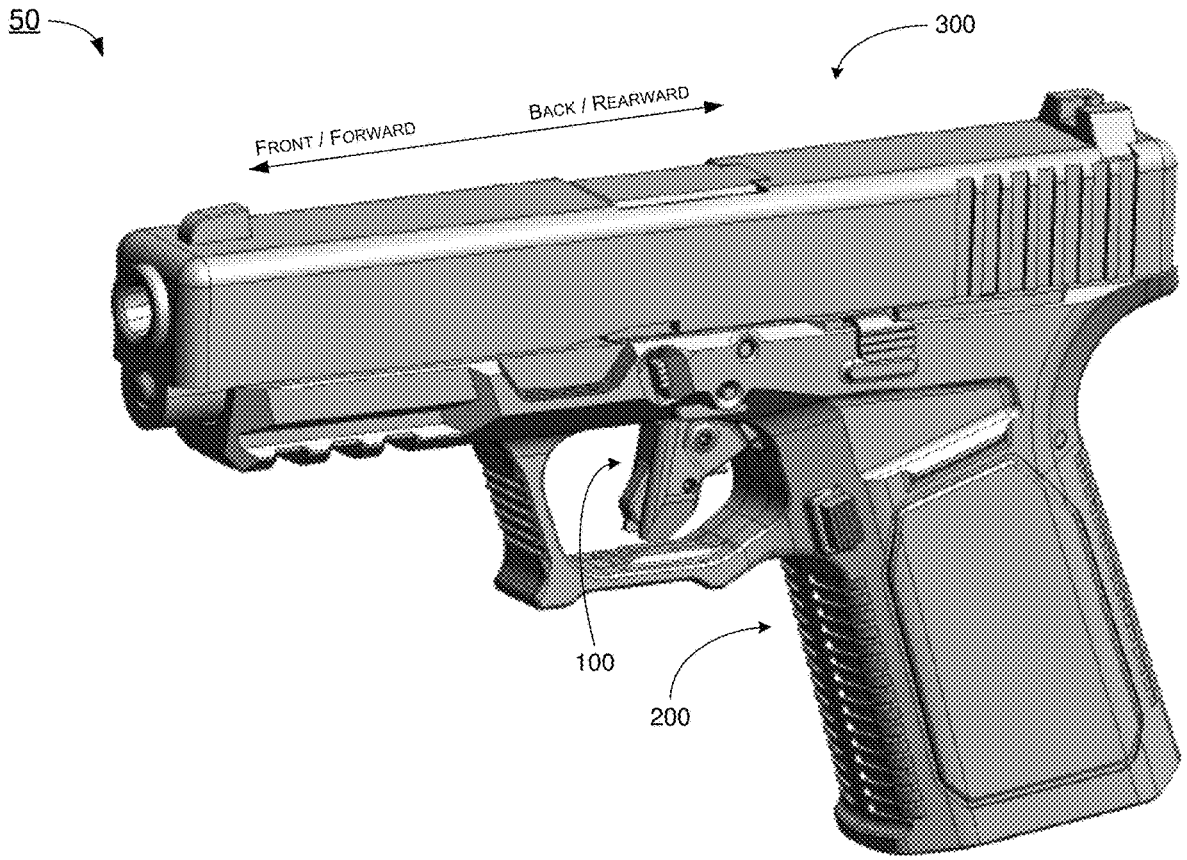
FIG. 2 is a diagram of a firearm in accordance with an implementation of the present disclosure.

FIG. 2 illustrates firearm 50 in accordance with an implementation of the present disclosure. Referring to FIG. 2, in addition to trigger control unit 100 and grip frame 200, firearm 50 may also include a slide assembly 300. Trigger control unit 100 may be installed between grip frame 200 and slide assembly 300. In the example shown in FIG. 2, slide assembly 300 may contain a striker-firing mechanism 350 (shown in FIG. 3), a barrel and a recoil spring assembly therein.

Figure 3:
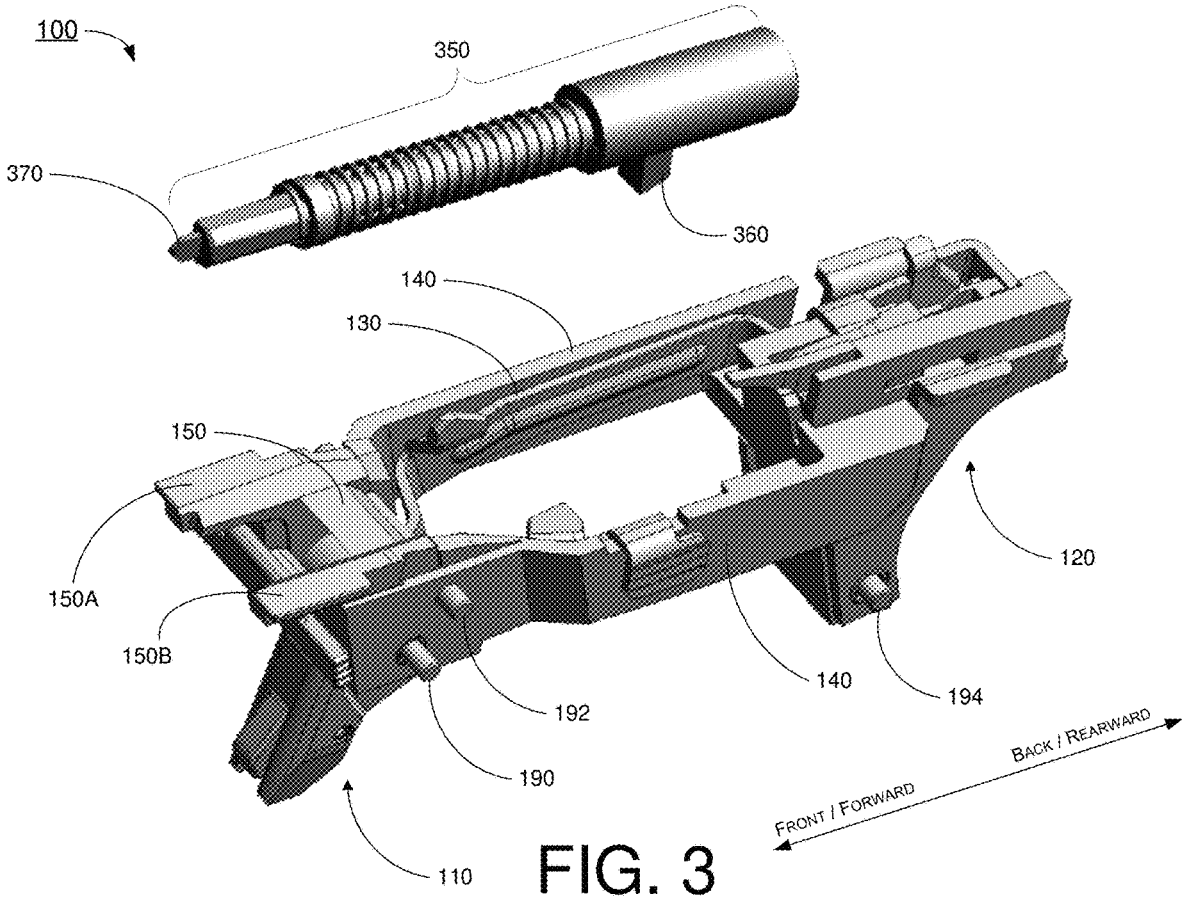
FIG. 3 is a diagram of an assembly of a portable trigger control unit in accordance with an implementation of the present disclosure.

FIG. 3 illustrates an assembly of portable trigger control unit 100 in accordance with an implementation of the present disclosure. Referring to FIG. 3, in addition to trigger pin 190, locking block pin 192 and trigger housing pin 194, trigger control unit 100 may also include a trigger 110, a trigger mechanism housing 120, a trigger bar 130, a support frame 140, and a locking block 150 with a pair of slide rails 150A and 150B.

Trigger 110 may be pivotable around trigger pin 190 when pulled by a user. In response to trigger 110 being pulled by the user when trigger control unit 100 is installed between grip frame 200 and slide assembly 300, a firing pin lug 360 of the striker-firing mechanism 350 in slide assembly 300 may be released thereby allowing a striker 370 of the striker-firing mechanism 350 to move forward with respect to slide assembly 300. Thus, a user can grip the grip frame 200 and squeeze trigger 110 of trigger control unit 100, among other actions, to fire a round of ammunition.

Trigger bar 130 may be coupled between trigger 1110 and the trigger mechanism housing 120. In response to trigger 110 being pulled by the user when trigger control unit 100 is installed between grip frame 200 and slide assembly 300, trigger bar 130 may cause a sear in the trigger mechanism housing to lower relative to slide assembly 300 such that the firing pin lug is released (e.g., to strike the primer of a round of ammunition if the round is chambered).

Support frame 140 may have a first distal end (e.g., front) and a second distal end (e.g., back) opposite the first distal end. Trigger 110 may be pivotably coupled to the first distal end of support frame 140 with trigger pin 190 traversing through trigger 110 and the first distal end of support frame 140. Moreover, trigger mechanism housing 120 may be coupled to the second distal end of support frame 140. Support frame 140 may be made of a polymeric material, metal or a composite of metal and polymer.

The pair of slide rails 150A and 150B of locking block 150 may extend forward and protrude from a front side of support frame 140 with respect to firearm 50. When trigger control unit 100 is installed between grip frame 200 and the slide assembly 300, slide assembly 300 may be movable forwardly and rearwardly with respect to grip frame 200 on the slide rails 150A and 150B.

In terms of modularity and customization, trigger control unit 100 may be configured to be removably installed on or otherwise removably received in each of a plurality of grip frames and installed between each of the plurality of grip frames and each of a plurality of slide assemblies such that: (a) at least two of the plurality of grip frames have different sizes (e.g., full, carry, compact and subcompact), different colors (e.g., black, flat dark earth (FDE), olive drab (OD) and grey), or different sizes and colors, and/or (b) at least two of the plurality of slide assemblies have different sizes, different colors, different calibers, or any combination thereof.

Figure 4:
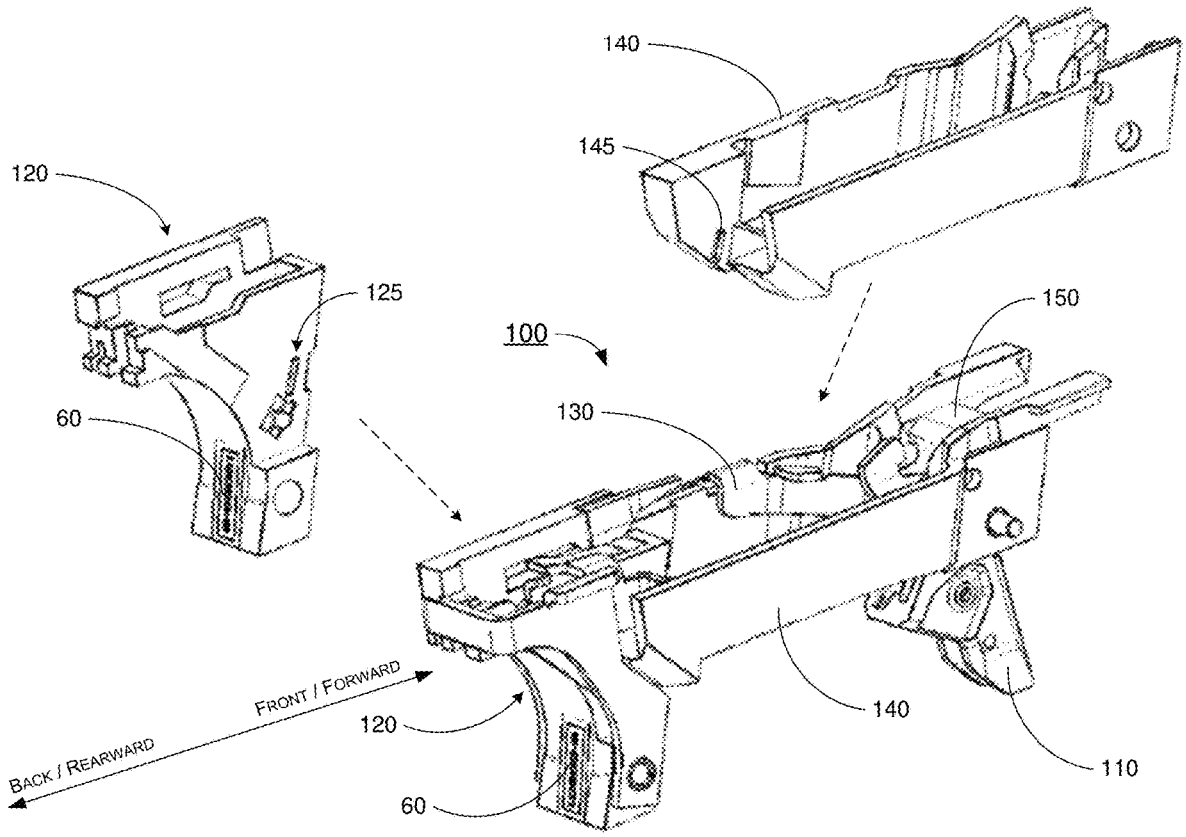
FIG. 4 is a diagram of an exploded view of a portable trigger control unit in accordance with an implementation of the present disclosure.
Figure 5:
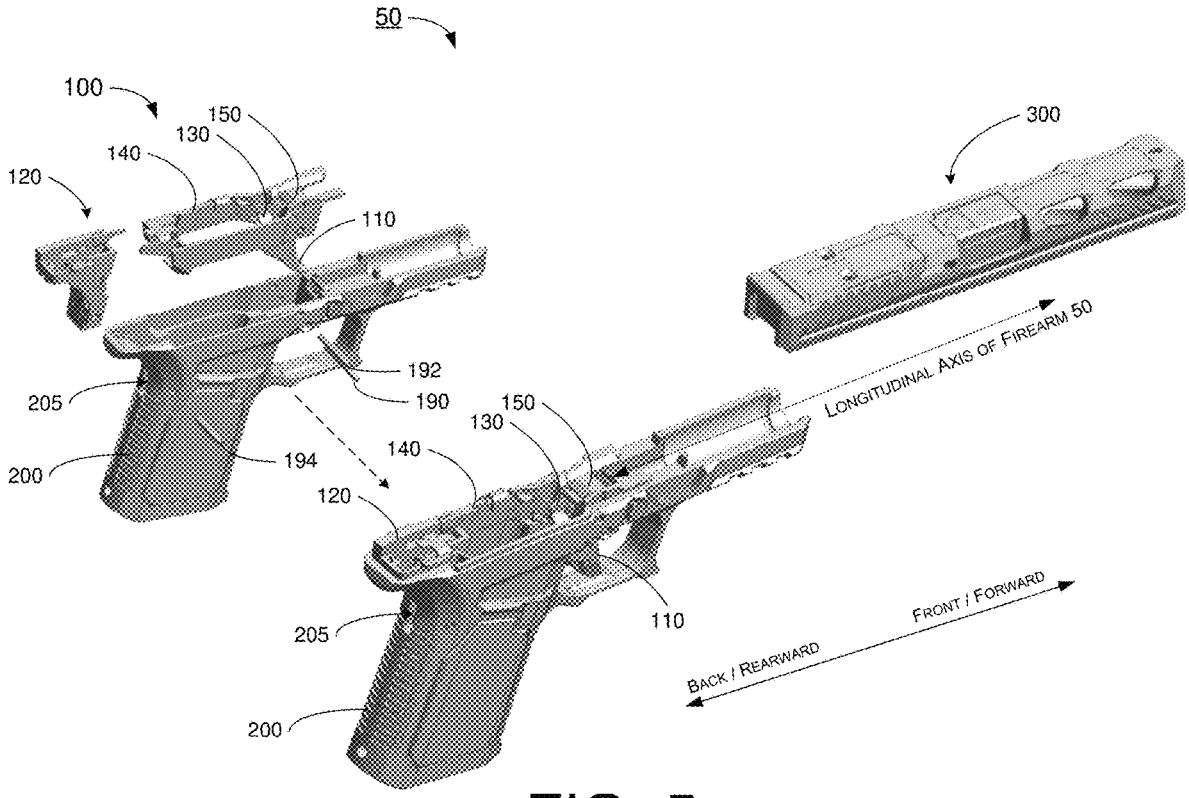
FIG. 5 is a diagram of major components of a firearm in accordance with an implementation of the present disclosure.

FIG. 4 illustrates an exploded view of portable trigger control unit 100 in accordance with an implementation of the present disclosure. FIG. 5 illustrates major components of firearm 50 in accordance with an implementation of the present disclosure.

Referring to FIG. 4 and FIG. 5, trigger control unit 100 may be removably received in grip frame 200 of a semi-automatic (or full-automatic) firearm 50 and may be installed between grip frame 200 and slide assembly 300 of firearm 50. Slide assembly 300 may contain a striker-firing mechanism and may be longitudinally movable (e.g., forwardly and rearwardly) on grip frame 200 when slide assembly 300 is installed on grip frame 200 with trigger mechanism housing 120 installed between slide assembly 300 and grip frame 200. Accordingly, when activated, trigger control unit 100 may cause firing of one or more rounds of ammunition. Under a proposed design in accordance with the present disclosure, and as described above, trigger control unit 100 may include at least the following major components: a trigger mechanism housing 120, a trigger pin 190, a trigger 110 that is pivotable around trigger pin 190 when pulled, a trigger bar 130 coupled between trigger 110 and trigger mechanism housing 120, a locking block 150, and a support frame 140. Support frame 140 may have a first distal end (e.g., front end) and a second distal end (e.g., back end) opposite the first distal end such that the first distal end faces a front side of grip frame 200 and the second distal end faces the back side of grip frame 200 when trigger control unit 100 is installed on or otherwise received in grip frame 200. The back side of grip frame 200 is the side of grip frame 200 that is opposite, or 180° from, a muzzle of firearm 50 and faces toward a user of firearm 50.

Under the proposed design, an identification marking 60 of firearm 50 (e.g., one or more of the following: a serial number, a caliber, a model name or number, and a name of a manufacturer) may be displayed on trigger mechanism housing 120. For instance, identification marking 60 may be displayed on a back surface of trigger mechanism housing 120 which faces a back side of grip frame 200 along a centerline 210 of the back side of grip frame 200 when trigger mechanism housing 120 is received in or otherwise installed on grip frame 200. Centerline 210 is a line with an equal distance to each of the left side and the right side of grip frame 200 when viewed from the back side of grip frame 200. Accordingly, when trigger mechanism housing 120 is received in grip frame 200, identification marking 60 of firearm displayed 50, which is displayed on and along centerline 210 of the back side of trigger mechanism housing 120, can be visible through an opening 205 on a back side of grip frame 200. As identification marking 60 is displayed on trigger mechanism housing 120, under current United States laws and regulations, trigger mechanism housing 120 itself may be considered as a firearm.

Under the proposed design, trigger mechanism housing 120 may be configured to be removably received in each of a plurality of grip frames and installed between each of the plurality of grip frames and each of a plurality of corresponding slide assemblies. Under the proposed design, at least two of the plurality of grip frames may have different sizes, different colors, or different sizes and colors. Alternatively, at least two of the plurality of slide assemblies may have different sizes, different colors, different calibers, or any combination thereof.

Under the proposed design, in response to trigger 110 being pulled by a user when trigger control unit 100 is installed between grip frame 200 and slide assembly 300, a firing pin lug of a striker-firing mechanism in slide assembly 300 may be released thereby allowing a striker of the striker-firing mechanism to move forward with respect to slide assembly 300. Additionally, trigger control unit 100 may be secured to grip frame 200 at least by trigger pin 190 such that removal of trigger control unit 100 from grip frame 200 requires removal of trigger pin 190. Also, in response to trigger 110 being pulled by the user when trigger control unit 100 is installed between grip frame 200 and slide assembly 300, trigger bar 130 may cause a sear in trigger mechanism housing 120 to lower relative to slide assembly 300 such that the firing pin lug is released. Moreover, trigger 110 may be pivotably coupled to the first distal end of support frame 140 with trigger pin 190 traversing through trigger 110 and the first distal end of support frame 140. In such cases, trigger mechanism housing 120 may be coupled to the second distal end of support frame 140. Furthermore, locking block 150 may include a pair of slide rails 150A and 150B extending forward from support frame 140 with respect to grip frame 200 as well as firearm 50. In such cases, when trigger control unit 100 is installed between grip frame 200 and slide assembly 300, slide assembly 300 may be movable longitudinally (e.g., forwardly and rearwardly) with respect to grip frame 200 on the slide rails.

Under the proposed design, support frame 140 may be made of a polymeric material, metal or a composite of metal and polymer. Under the proposed design, each of trigger mechanism housing 120 and support frame 140 may be configured with physical features that allow support frame 140 to be snapped onto trigger mechanism housing 120 to be physically or otherwise mechanically coupled to each other. For instance, trigger mechanism housing 120 may be configured with a left indentation on a left side thereof and a right indentation (which is identified by numeral reference 125 in FIG. 4) on a right side thereof. Moreover, support frame 140 may be configured with a left protrusion (which is identified by numeral reference 145 in FIG. 4) on a left inner surface near the second distal end and a right protrusion on a right inner surface near the second distal end. In such cases, support frame 140 may be coupled to trigger mechanism housing 120 by the left protrusion received in the left indentation and the right protrusion received in the right indentation. Alternatively, trigger mechanism housing 120 may be configured with a left protrusion on a left side thereof and a right protrusion on a right side thereof. Moreover, support frame 140 may be configured with a left indentation on a left inner surface near the second distal end and a right indentation on a right inner surface near the second distal end. In such cases, support frame 140 may be coupled to trigger mechanism housing 120 by the left protrusion received in the left indentation and the right protrusion received in the right indentation.

Figure 6:
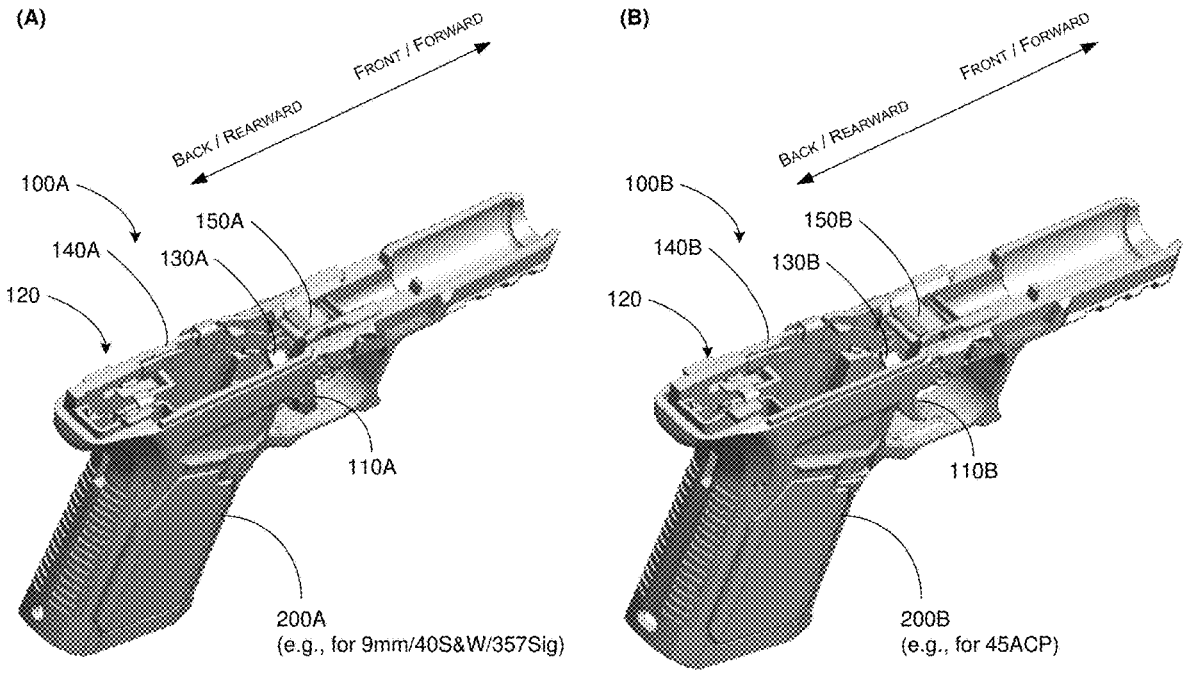
FIG. 6 is a diagram showing a perspective view of a portable trigger control unit in accordance with an implementation of the present disclosure installed on grip frames for different calibers of ammunition.
Figure 7:
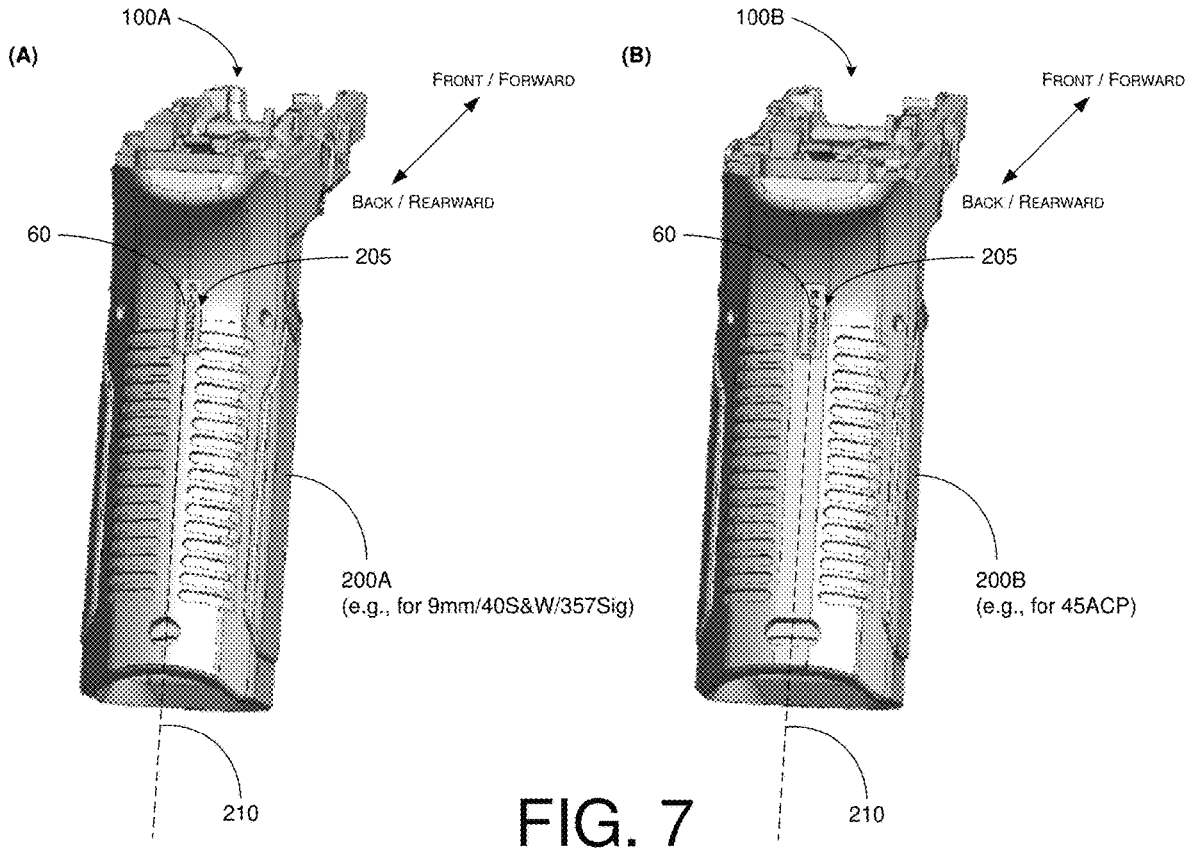
FIG. 7 is a diagram showing a back view of a portable trigger control unit in accordance with an implementation of the present disclosure installed on grip frames for different calibers of ammunition.

FIG. 6 illustrates a perspective view of a portable trigger control unit in accordance with an implementation of the present disclosure installed on grip frames for different calibers of ammunition. FIG. 7 illustrates a back view of a portable trigger control unit in accordance with an implementation of the present disclosure installed on grip frames for different calibers of ammunition.

For illustrative purposes and without limiting the scope of the present disclosure, part (A) of each of FIG. 6 and FIG. 7 shows a portable trigger control unit 100A installed on or otherwise received in grip frame 200A which is dimensioned or otherwise configured for calibers such as 9 mm, 40S&W and/or 357 Sig. Similarly, part (B) of each of FIG. 6 and FIG. 7 shows a portable trigger control unit 100B installed on or otherwise received in grip frame 200B which is dimensioned or otherwise configured for calibers such as 45ACP and/or 10 mm. That is, the size of grip frame 200B may be larger than the size of grip frame 200A in one or more dimensions.

As shown in part (A) of FIG. 6, portable trigger control unit 100A may include major components such as trigger 110A, trigger mechanism housing 120, trigger bar 130A, support frame 140A and locking block 150A. As shown in part (B) of FIG. 6, portable trigger control unit 100B may include major components such as trigger 110B, trigger mechanism housing 120, trigger bar 130B, support frame 140B, and locking block 150B. Although denoted differently, dimensions of trigger 110A and trigger 110B may be identical or different, dimensions of trigger bar 130B and trigger bar 130B may be identical or different, dimensions of support frame 140A and support frame 140B may be identical or different, and dimensions of locking block 150A and locking block 150B may be identical or different. In any event, under the proposed scheme, there is no need to change trigger mechanism housing 120 when changing grip frame, slide assembly and/or one or more other components of portable trigger control unit. That is, for modularity, except for trigger mechanism housing 120, some or all other components may be changed for different sizes, different colors and/or different calibers.

It is noteworthy that each of trigger 110, trigger 110A and trigger 110B may be identical to each other or may differ in one or more dimensions from each other and, thus, descriptions herein with respect to trigger 110 are applicable to trigger 110A and trigger 110B. Similarly, each of trigger bar 130, trigger bar 130A and trigger bar 130B may be identical to each other or may differ in one or more dimensions from each other and, thus, descriptions herein with respect to trigger bar 130 are applicable to trigger bar 130A and trigger bar 130B. Likewise, each of support frame 140, support frame 140A and support frame 140B may be identical to each other or may differ in one or more dimensions from each other and, thus, descriptions herein with respect to support frame 140 are applicable to support frame 140A and support frame 140B.

Advantageously, a user may purchase portable trigger control unit 100 (or just trigger mechanism housing 120 alone), which may be registered as a "firearm" since the identification marking 60 (e.g., serial number) is displayed on and along centerline 210, or otherwise coincides with centerline 210, of the back side of trigger mechanism housing 120, and the user may modularly customize the configuration of firearm 50 by utilizing the trigger control unit 100 (or trigger mechanism housing 120) with different grip frames, different slide assemblies and/or different barrels, with or without one or more components of trigger control unit 100 changed to a different size (except trigger mechanism housing 120, which can remain unchanged from one configuration to another).

As shown in part (A) of FIG. 7, grip frame 200A may be configured with an opening or cutout on and along centerline 210 of the back side (e.g., facing back or rearward with respect to firearm 50 from a user's perspective) with a location aligned with or otherwise corresponding to a location of the identification marking 60 (e.g., serial number) of firearm 50 displayed on the back side of trigger mechanism housing 120. Similarly, as shown in part (B) of FIG. 7, grip frame 200B may be configured with an opening or cutout on and along centerline 210 of the back side thereof (e.g., facing back or rearward with respect to firearm 50 from a user's perspective) with a location aligned with or otherwise corresponding to a location of the identification marking 60 (e.g., serial number) of firearm 50 displayed on the back side of trigger mechanism housing 120.

Figure 8:
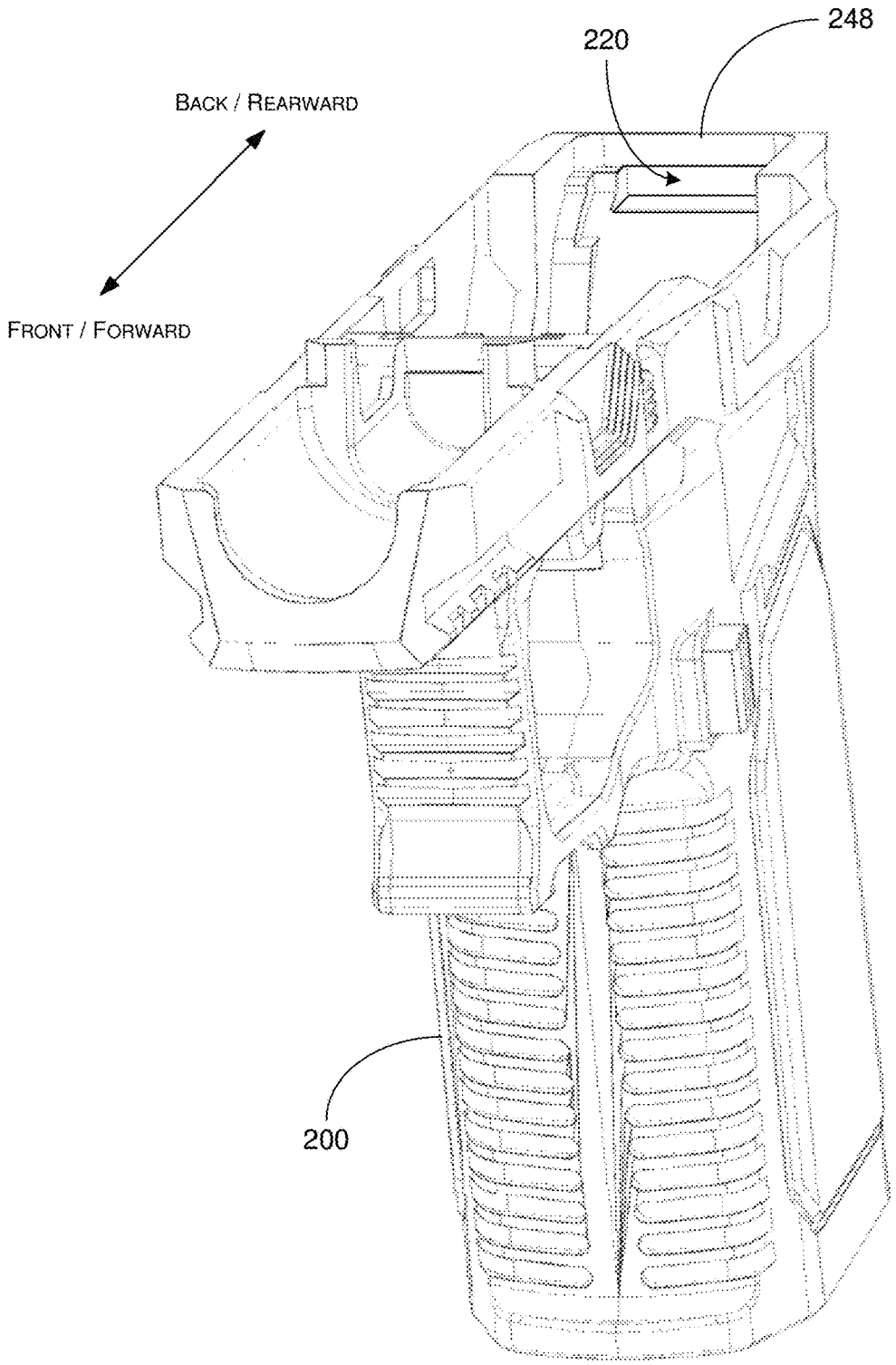
FIG. 8 is a diagram of a grip frame of a firearm in accordance with an implementation of the present disclosure.
Figure 9:
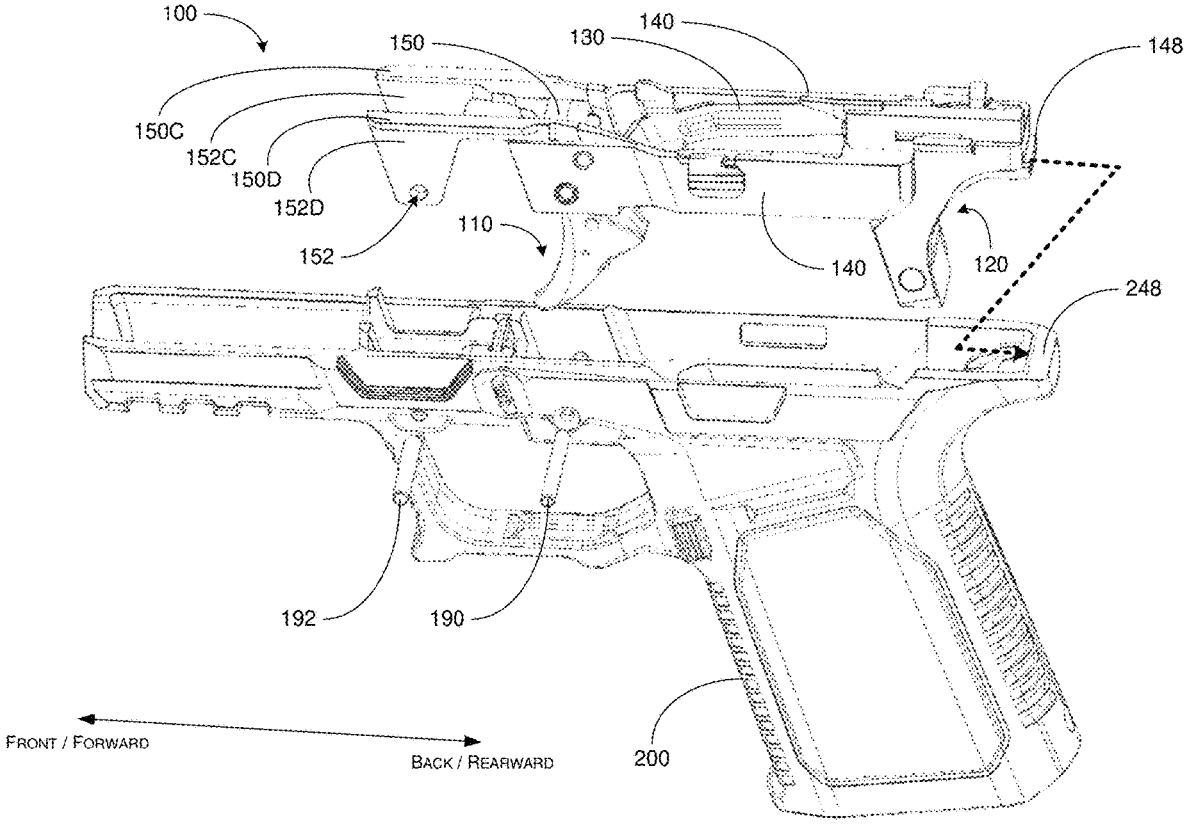
FIG. 9 is a diagram of an exploded view of some of the components of a firearm in accordance with an implementation of the present disclosure.
Figure 10:
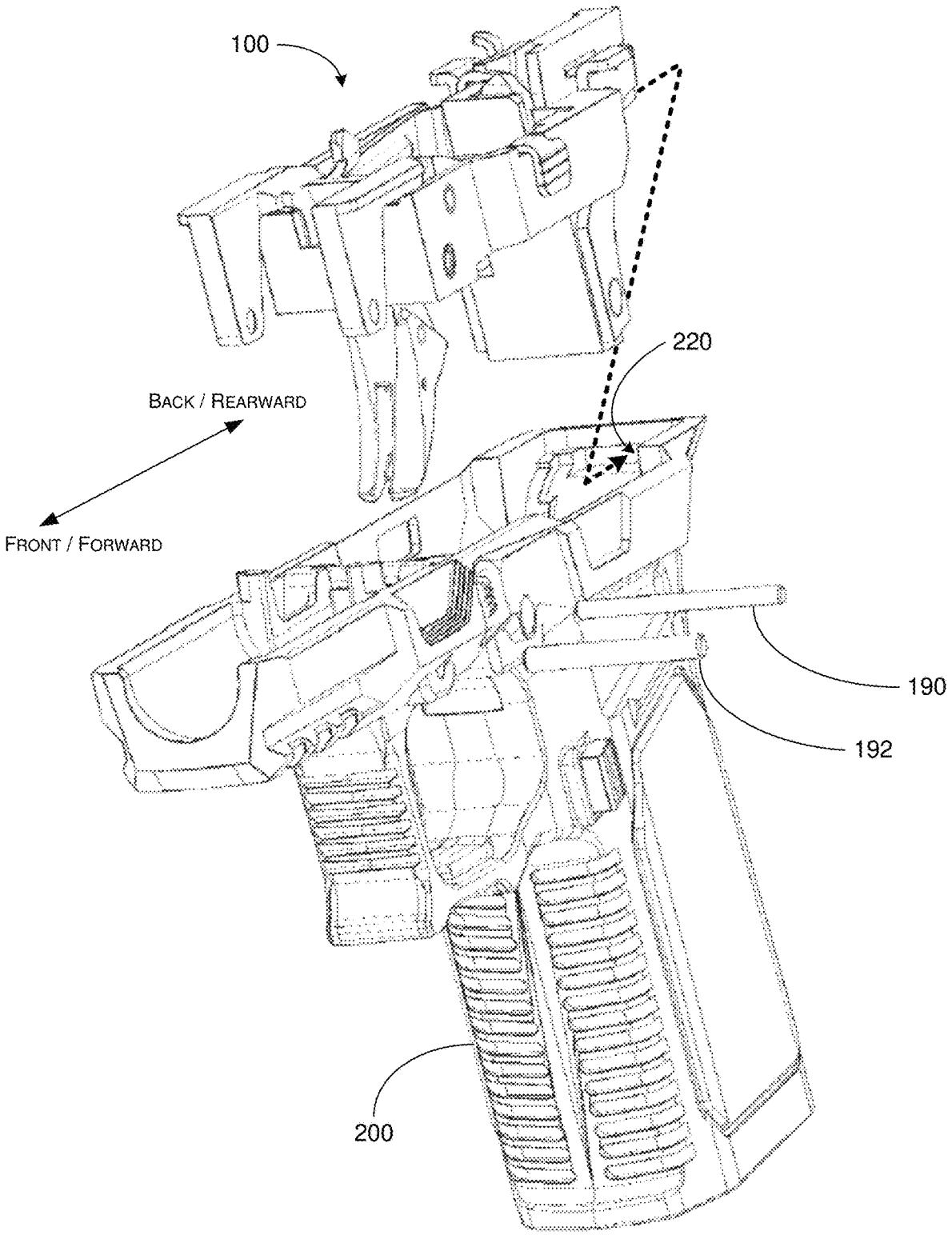
FIG. 10 is a diagram of another exploded view of some of the components of the firearm of FIG. 9.
Figure 11:
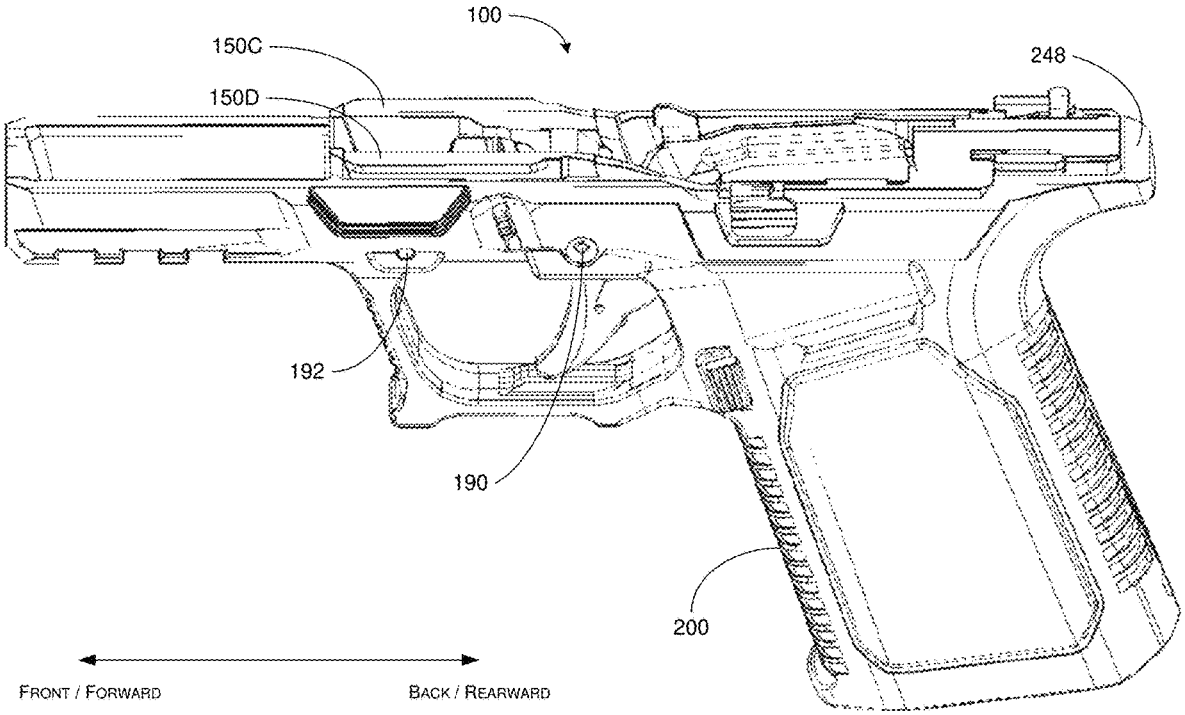
FIG. 11 is a diagram showing a perspective view of a portable trigger control unit installed on a grip frame of the firearm of FIG. 9.

FIG. 8 illustrates grip frame 200 of firearm 50 in accordance with a proposed design of the present disclosure. Each of FIG. 9, FIG. 10 and FIG. 11 illustrates a respective view of some of the components of firearm 50 in accordance with a proposed design of the present disclosure. Referring to FIG. 8 and FIG. 9~FIG. 11, grip frame 200 may have a beavertail portion 248 at the back end thereof. That is, beavertail portion 248 may protrude rearward (e.g., toward a user when firearm 50 is held by the user). Under a proposed design, an interior wall of beavertail portion 248 may be configured with an indentation or recess 220 which may be configured, sized or otherwise dimensioned to receive a protruding tab 148 of trigger control unit 100.

Under a proposed design, protruding tab 148 may be formed by a rearward protrusion of trigger mechanism housing 120, which may be made of a metal. Under another proposed design, protruding tab 148 may be formed by a rearward protrusion of support frame 140, which may be made of polymer. Under yet another proposed design, protruding tab 148 may be partially formed by a rearward protrusion of trigger mechanism housing 120 and partially formed by a rearward protrusion of support frame 140. That is, in this design, protruding tab 148 may be a composite of metal and polymer (e.g., partly metal and partly polymer). When protruding tab 148 is received in recess 220, protruding tab 148 and recess 220 together form a "beavertail lock" at or in beavertail portion 248 of grip frame 200, thereby snugly securing the back end of trigger control unit 100 to grip frame 200.

Referring to FIG. 9~FIG. 11, under a proposed design, locking block 150 may be configured with a pair of longer slide rails 150C and 150D, which are longer than 150A and 150B, respectively, described above and shown in FIG. 1~FIG. 6. Slide rails 150C and 150D may extend forward and protrude from a front side of support frame 140 (even further than slide rails 150A and 150B) with respect to the trigger 110, trigger pin 190 and firearm 50. When trigger control unit 100 is installed between grip frame 200 and the slide assembly 300, slide assembly 300 may be movable forwardly and rearwardly with respect to grip frame 200 on the slide rails 150C and 150D. Under a proposed design, a flat wall 152C may extend downward or upward from slide rail 150C with respect to grip frame 200 and, similarly, a flat wall 152D may extend downward or upward from slide rail 150D with respect to grip frame 200. Moreover, each of flat wall 152C and flat wall 152D may be configured with a through hole 152 for receiving locking block pin 192. Accordingly, when trigger control unit 100 is received, mounted, seated or otherwise installed in a hollow of grip frame 200, trigger control unit 100 may be fixed or otherwise secured to grip frame by locking block pin 192 (by traversing through holes on grip frame 200 and through holes 152 on flat wall 152C and flat wall 152D), trigger pin 190, and beavertail lock formed by protruding tab 148 and recess 220 as described above. That is, when trigger control unit 100 is secured to grip frame 200, locking block pin 192 is forward of trigger pin 190 (e.g., compared to trigger pin 1909, locking block pin 192 is closer to a muzzle of firearm 50 and farther away from the back side of grip frame 200). Advantageously, with an opening or cutout on and along centerline 210 of the back side of grip frame 200, identification marking 60 (e.g., serial number) of firearm 50 displayed on trigger mechanism housing 120 may coincide with centerline 210 as well as the opening/cutout and, therefore, may be visible to a user through the opening or cutout.

Figure 12:
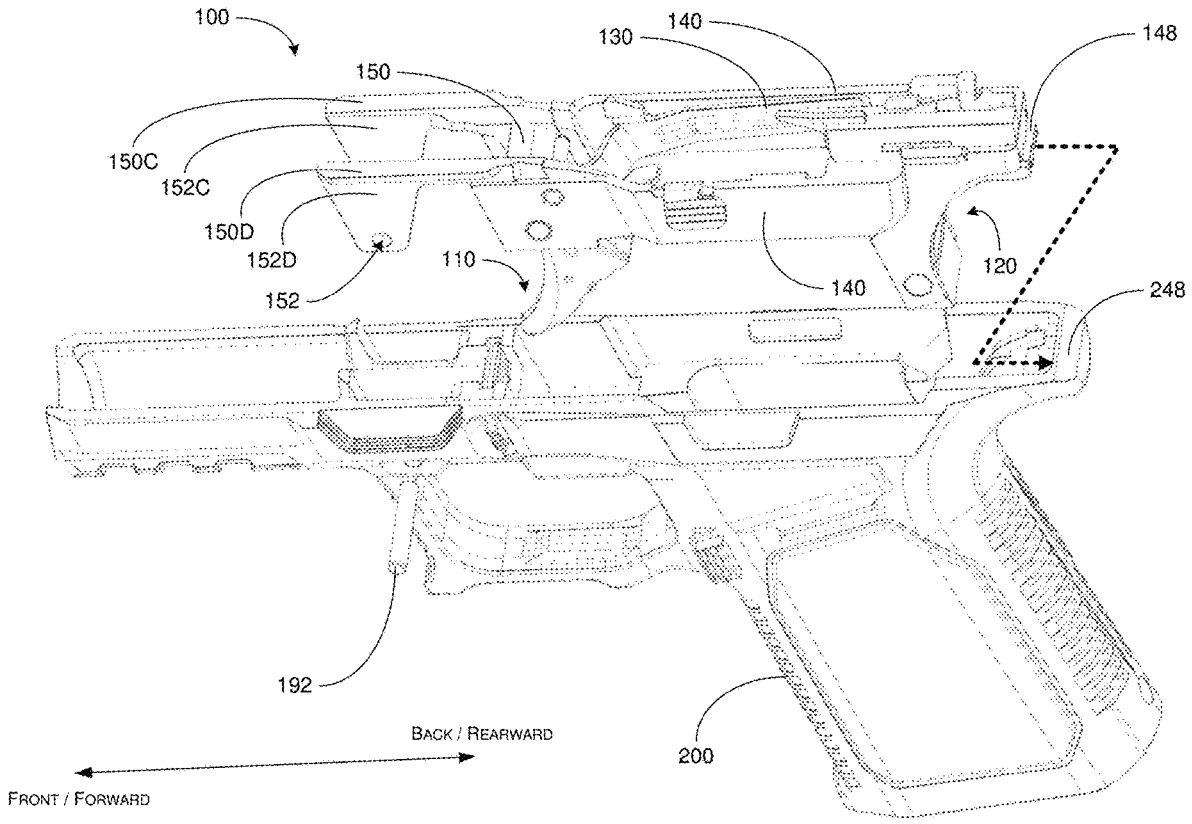
FIG. 12 is a diagram of an exploded view of some of the components of a firearm in accordance with an implementation of the present disclosure.
Figure 13:
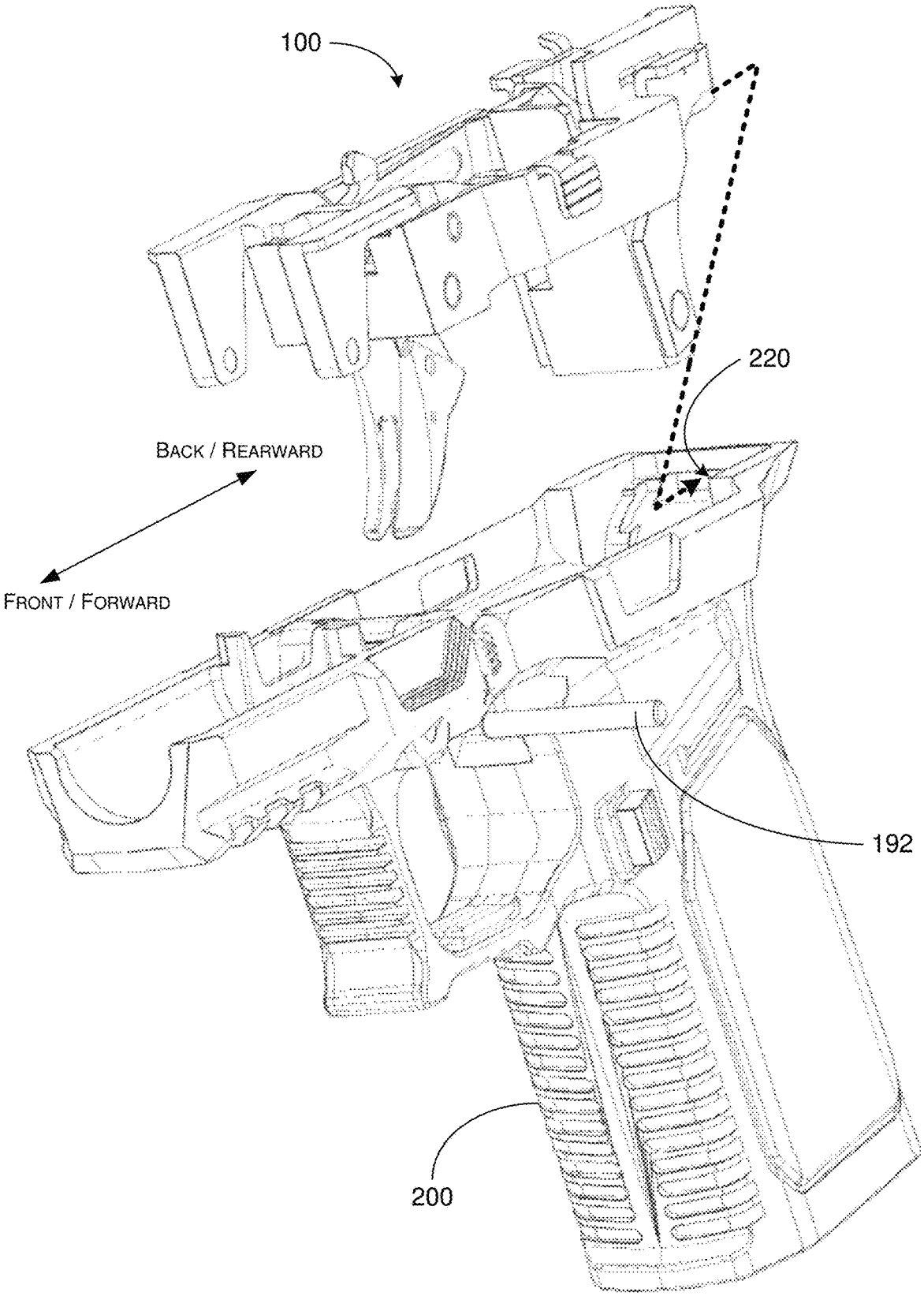
FIG. 13 is a diagram of another exploded view of some of the components of the firearm of FIG. 12.
Figure 14:
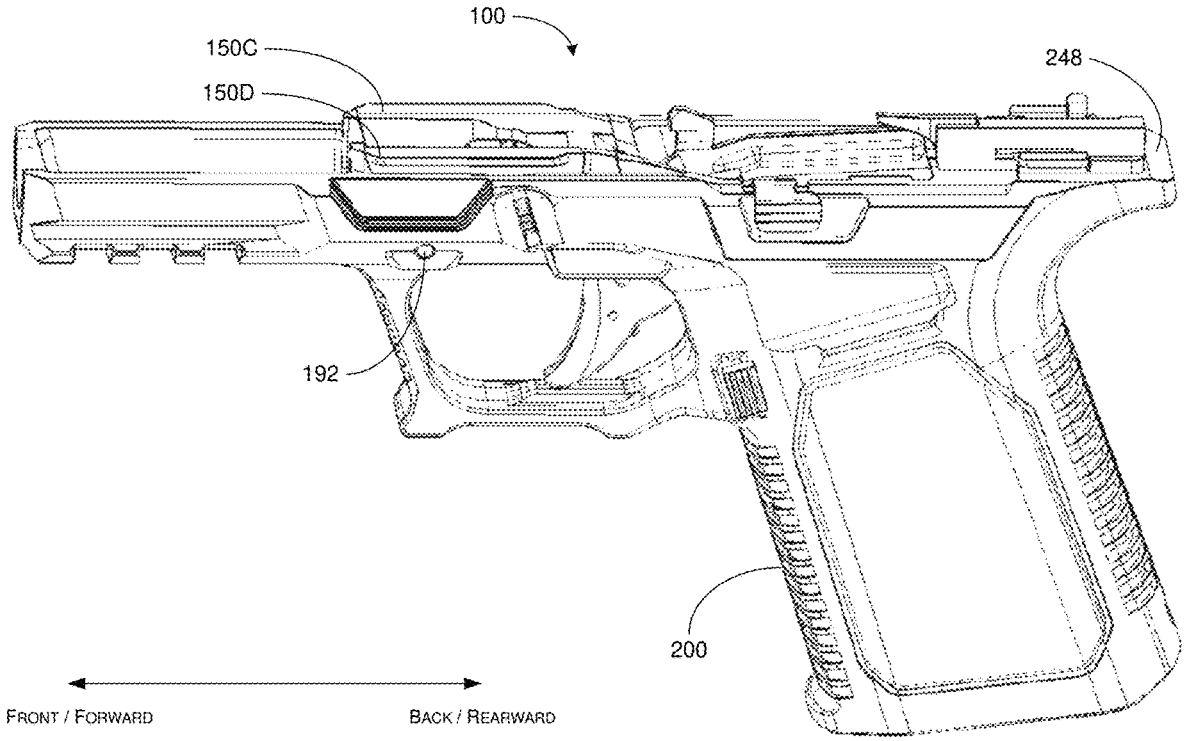
FIG. 14 is a diagram showing a perspective view of a portable trigger control unit installed on a grip frame of the firearm of FIG. 12.

Each of FIG. 12, FIG. 13 and FIG. 14 illustrates a respective view of some of the components of firearm 50 in accordance with a proposed design of the present disclosure. Referring to FIG. 8 and FIG. 12~FIG. 14, grip frame 200 may have a beavertail portion 248 at the back end thereof. That is, beavertail portion 248 may protrude rearward (e.g., toward a user when firearm 50 is held by the user). Under a proposed design, beavertail portion 248 may be configured with an indentation or recess 220 which may be configured, sized or otherwise dimensioned to receive a protruding tab 148 of trigger control unit 100.

Under a proposed design, protruding tab 148 may be formed by a rearward protrusion of trigger mechanism housing 120, which may be made of a metal. Under another proposed design, protruding tab 148 may be formed by a rearward protrusion of support frame 140, which may be made of polymer. Under yet another proposed design, protruding tab 148 may be partially formed by a rearward protrusion of trigger mechanism housing 120 and partially formed by a rearward protrusion of support frame 140. That is, in this design, protruding tab 148 may be a composite of metal and polymer (e.g., partly metal and partly polymer). When protruding tab 148 is received in recess 220, protruding tab 148 and recess 220 together form a "beavertail lock" at or in beavertail portion 248 of grip frame 200, thereby snugly securing the back end of trigger control unit 100 to grip frame 200.

Referring to FIG. 12~FIG. 14, under a proposed design, locking block 150 may be configured with a pair of longer slide rails 150C and 150D, which are longer than 150A and 150B, respectively, described above and shown in FIG. 1~FIG. 6. Slide rails 150C and 150D may extend forward and protrude from a front side of support frame 140 (even further than slide rails 150A and 150B) with respect to firearm 50. When trigger control unit 100 is installed between grip frame 200 and the slide assembly 300, slide assembly 300 may be movable forwardly and rearwardly with respect to grip frame 200 on the slide rails 150C and 150D. Under a proposed design, a flat wall 152C may extend downward or upward from slide rail 150C with respect to grip frame 200 and, similarly, a flat wall 152D may extend downward or upward from slide rail 150D with respect to grip frame 200. Moreover, each of flat wall 152C and flat wall 152D may be configured with a through hole 152 for receiving locking block pin 192. Accordingly, when trigger control unit 100 is received, mounted, seated or otherwise installed in a hollow of grip frame 200, trigger control unit 100 may be fixed or otherwise secured to grip frame by locking block pin 192 (by traversing through holes on grip frame 200 and through holes 152 on flat wall 152C and flat wall 152D) and beavertail lock formed by protruding tab 148 and recess 220 as described above. That is, when trigger control unit 100 is secured to grip frame 200, locking block pin 192 is forward of trigger pin 190 (e.g., compared to trigger pin 1909, locking block pin 192 is closer to a muzzle of firearm 50 and farther away from the back side of grip frame 200). Advantageously, with an opening or cutout on and along centerline 210 of the back side of grip frame 200, identification marking 60 (e.g., serial number) of firearm 50 displayed on trigger mechanism housing 120 may coincide with centerline 210 as well as the opening/cutout and, therefore, may be visible to a user through the opening or cutout.

As can be seen, one major difference between the proposed design shown in FIG. 9~11 and the proposed design shown in FIG. 12~14 is that, in the proposed design shown in FIG. 9~11 trigger control unit 100 is secured to grip frame by three components, namely: locking block pin 192, trigger pin 120 and the "beavertail lock" formed by protruding tab 148 and recess 220. In contrast, in the proposed design shown in FIG. 12~14 trigger control unit 100 is secured to grip frame by two components, namely: locking block pin 192 and the "beavertail lock" formed by protruding tab 148 and recess 220.

It is noteworthy that, when firearm 50 is fired (e.g., when a round of ammunition cartridge is discharged), the recoil energy is typically transferred from the barrel of firearm 50 to the slide of slide assembly 300, as well as trigger control unit 100, and then to grip frame 200 of firearm 50. Under various proposed schemes in accordance with the present disclosure, trigger control unit 100 and grip frame 200, as two separate pieces, may be assembled together by: (1) any pin (e.g., trigger pin 190, locking block pin 192 and/or trigger housing pin 194) traversing across trigger control unit 100 and corresponding through holes on grip frame 200, and (2) protruding tab 148 protruding reward and received in beavertail portion 248 of grip frame 200. Accordingly, when the recoil force is directly exerted on or applied to trigger control unit 100, energy of the recoil force is transferred to grip frame 200, with the pin(s) and protruding tab 148 absorbing or otherwise holding the energy.

Figure 15:
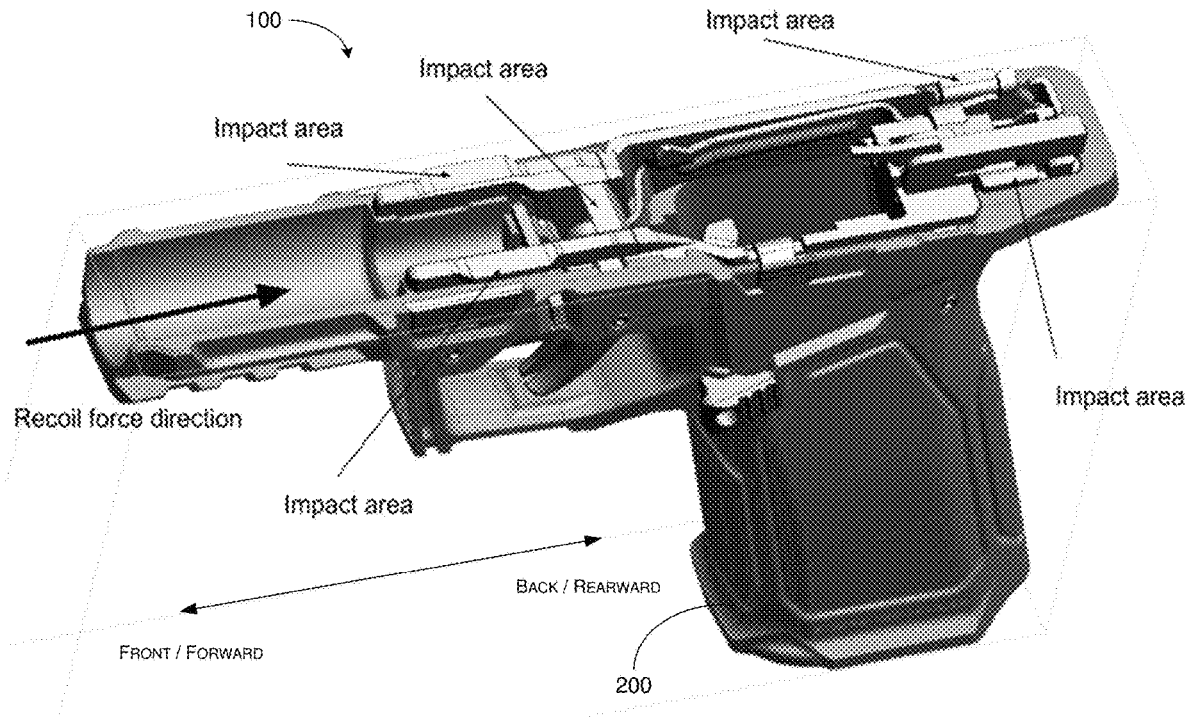
FIG. 15 is a diagram of an assembly view of some of the components of a firearm in accordance with an implementation of the present disclosure.

Referring to FIG. 15, there are multiple "impact areas" on various components and/or portions of trigger control unit 100 and grip frame 200 where energy of the recoil force may be exerted or otherwise applied. As can be seen, one or more pins (e.g., trigger pin 190, locking block pin 192 and/or trigger housing pin 194) and protruding tab 148 may be considered as connection points between trigger control unit 100 and grip frame 200 through which the energy of the recoil force is transferred from trigger control unit 100 and grip frame 200.

In order to evenly distribute the energy of the recoil force onto trigger control unit 100 and grip frame 200, under the proposed schemes, physical features (herein referred to as "force-dispersing support features"), such as male extension tabs and female slots (or indentations), may be configured on trigger control unit 100 and grip frame 200 to evenly distribute the energy of the recoil force onto trigger control unit 100 and grip frame 200. For instance, in some implementations, trigger control unit 100 may be configured with one or more male laterally-protruding tabs while grip frame 200 may be configured with one or more corresponding female slots (or indentations) that mate with the one or more male laterally-protruding tabs on trigger control unit 100 when trigger control unit 100 is installed on grip frame 200. Alternatively, trigger control unit 100 may be configured with one or more female slots (or indentations) while grip frame 200 may be configured with one or more corresponding male laterally-protruding tabs that mate with the one or more female slots (or indentations) on trigger control unit 100 when trigger control unit 100 is installed on grip frame 200. Still alternatively, trigger control unit 100 may be configured with at least one male laterally-protruding tab and at least one female slot (or indentation) while grip frame 200 may be configured with at least one corresponding female slot (or indentation) and at least one corresponding male laterally-protruding tab that mate with the at least one male laterally-protruding tab and at least one female slot (or indentation) on trigger control unit 100 when trigger control unit 100 is installed on grip frame 200.

Figure 16:
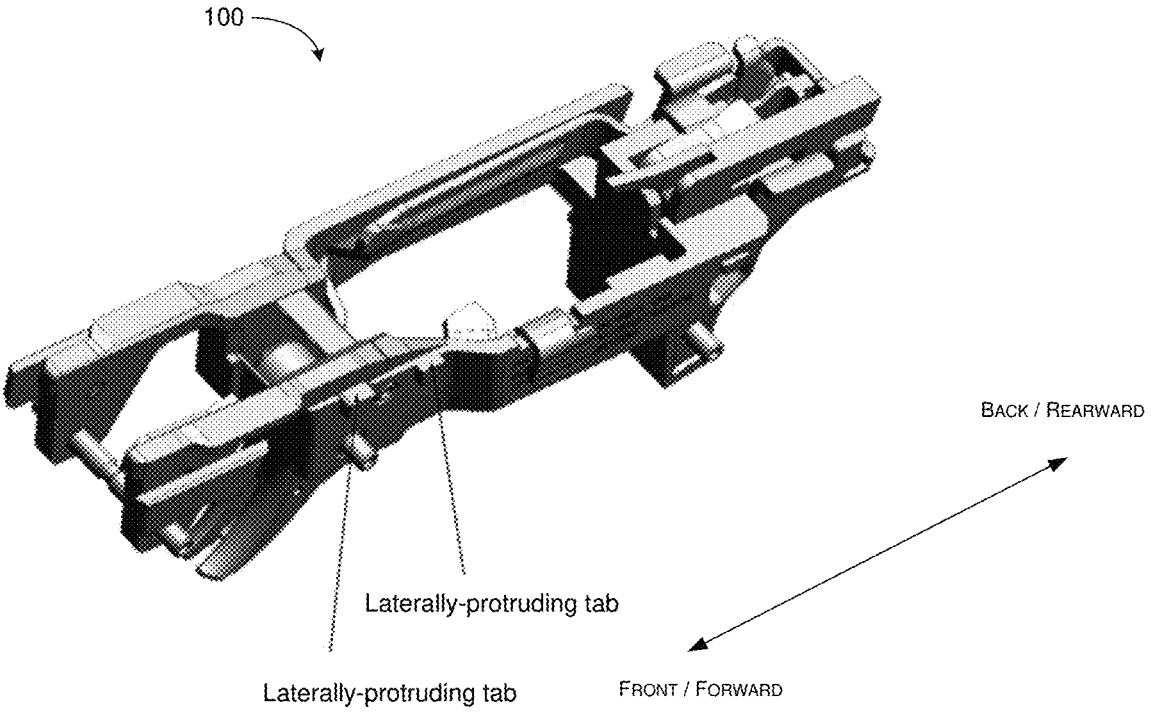
FIG. 16 is a diagram of an example trigger control unit in accordance with an implementation of the present disclosure.
Figure 17:
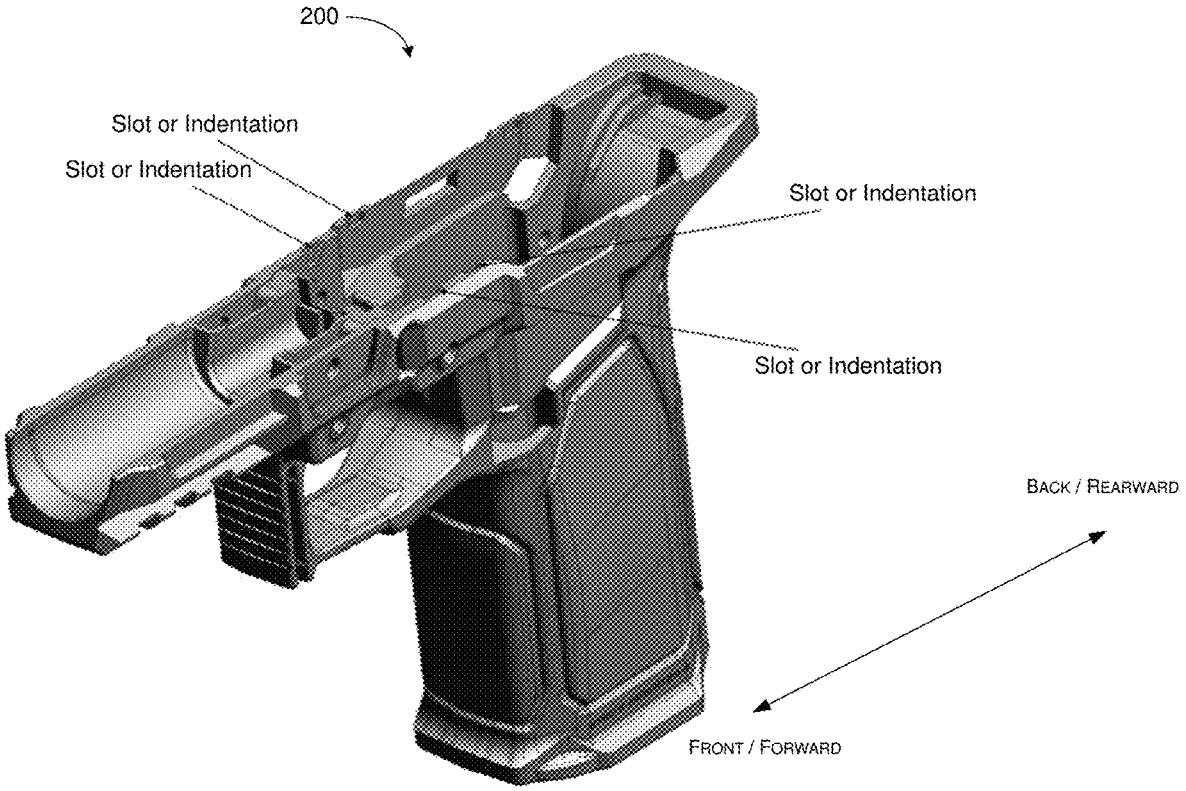
FIG. 17 is a diagram of an example grip frame in accordance with an implementation of the present disclosure.

In the examples shown in FIG. 16 and FIG. 17, trigger control unit 100 may be configured with one or more male laterally-protruding tabs and grip frame 200 may be configured with one or more corresponding female slots (or indentations) that mate with the one or more male laterally-protruding tabs on trigger control unit 100. Variations from the examples shown in FIG. 16 and FIG. 17 are possible, as described above, and thus are also within the scope of the present disclosure although not explicitly shown in the figures.

Feature Highlight

In view of the above, select features of various implementations in accordance with the present disclosure are highlighted below.

In one aspect, an apparatus (e.g., a semi-automatic or full-automatic firearm such as firearm 50) may include a trigger control unit configured to be removably installed on a grip frame of a firearm. The trigger control unit may include a locking block and a pin configured to traverse through both the trigger control unit and the grip frame. The trigger control unit may have a protruding tab protruding rearward with respect to the firearm. The locking block may include a pair of slide rails extending forward with respect to the firearm, with each slide rail of the pair of slide rails having a flat wall extending downward or upward with respect to the grip frame when the trigger control unit is installed on the grip frame. Accordingly, the trigger control unit may be secured to the grip frame by: (1) the protruding tab received in a recess on an interior wall of a beavertail portion of the grip frame; (2) the pin; and (3) one or more first physical features on the trigger control unit mating with one or more second physical features on the grip frame.

In some implementations, the one or more first physical features may include at least one laterally-protruding tab and the one or more second physical features may include at least one slot or indentation configured to mate with the at least one laterally-protruding tab when the trigger control unit is installed on the grip frame. Alternatively, the one or more second physical features may include at least one laterally-protruding tab and the one or more first physical features may include at least one slot or indentation configured to mate with the at least one laterally-protruding tab when the trigger control unit is installed on the grip frame.

In some implementations, the trigger control unit may also include a trigger mechanism housing configured to be removably received in the grip frame of the firearm. When the trigger control unit is installed between the grip frame and a slide assembly of the firearm, the slide assembly may be movable forwardly and rearwardly with respect to the grip frame on the slide rails.

In some implementations, an identification marking of the firearm displayed on the trigger mechanism housing may coincide with a centerline of a back side of the grip frame.

In some implementations, the trigger control unit may further include a trigger pin, a trigger pivotable around the trigger pin when pulled, a trigger bar coupled between the trigger and the trigger mechanism housing, and a support frame having a first distal end and a second distal end opposite the first distal end such that the first distal end faces a front side of the grip frame and the second distal end faces the back side of the grip frame when the trigger control unit is installed on the grip frame.

In some implementations, the pin may include either or both of a locking block pin and the trigger pin. In an event that at least the locking block pin is utilized to secure the trigger control unit to the grip frame, the locking block pin may traverse through a through hole on the flat wall extending from each slide rail of the pair of slide rails such that removal of the trigger control unit from the grip frame requires removal of the locking block pin.

In some implementations, the trigger control unit may be secured to the grip frame at least by the protruding tab, the locking block pin and the trigger pin such that removal of the trigger control unit from the grip frame requires removal of the locking block pin and the trigger pin. Additionally, responsive to the trigger being pulled by the user when the trigger control unit is installed between the grip frame and the slide assembly, the trigger bar may cause a sear in the trigger mechanism housing to lower relative to the slide assembly such that the firing pin lug is released. Moreover, the trigger may be pivotably coupled to the first distal end of the support frame with the trigger pin traversing through the trigger and the first distal end of the support frame. Furthermore, the trigger mechanism housing may be coupled to the second distal end of the support frame.

In some implementations, the support frame may be made of a polymeric material, metal or a composite of metal and polymer.

In some implementations, the trigger mechanism housing may be configured with a left indentation on a left side thereof and a right indentation on a right side thereof. Additionally, the support frame may be configured with a left protrusion on a left inner surface near the second distal end and a right protrusion on a right inner surface near the second distal end. Moreover, the support frame may be coupled to the trigger mechanism housing by the left protrusion received in the left indentation and the right protrusion received in the right indentation.

In some implementations, the protruding tab may be formed by either or both of a portion of the support frame and a portion of the trigger mechanism housing.

In some implementations, the trigger mechanism housing may be configured to be removably received in each of a plurality of grip frames and installed between each of the plurality of grip frames and each of a plurality of slide assemblies such that: (a) at least two of the plurality of grip frames have different sizes, different colors, or different sizes and colors, or (b) at least two of the plurality of slide assemblies have different sizes, different colors, different calibers, or any combination thereof.

In some implementations, the apparatus may also include the grip frame. The grip frame may have an opening on and along the centerline of the back side thereof and aligned with the identification marking of the firearm when the trigger mechanism housing is received in the grip frame such that the identification marking is visible through the opening. In some implementations, the apparatus may further include the slide assembly containing a striker-firing mechanism and longitudinally movable on the grip frame when the slide assembly is installed on the grip frame with the trigger mechanism housing installed between the slide assembly and the grip frame.

In another aspect, an apparatus (e.g., a semi-automatic or full-automatic firearm such as firearm 50) may include a trigger control unit configured to be removably received in a grip frame of a firearm and installed between the grip frame and a slide assembly of the firearm such that, when activated, the trigger control unit causes firing of one or more rounds of ammunition. The trigger control unit may include a trigger mechanism housing, a trigger pin, a trigger pivotable around the trigger pin when pulled, a trigger bar coupled between the trigger and the trigger mechanism housing, a locking block, a locking block pin, and a support frame having a first distal end and a second distal end opposite the first distal end such that the first distal end faces a front side of the grip frame and the second distal end faces a back side of the grip frame when the trigger control unit is installed on the grip frame. The locking block may include a pair of slide rails extending forward with respect to the trigger and the firearm, with each slide rail of the pair of slide rails having a flat wall extending downward or upward with respect to the grip frame when the trigger control unit is installed on the grip frame. Accordingly, the trigger control unit may be secured to the grip frame by: (1) either or both of the locking block pin and the trigger pin, and (2) one or more first physical features on the trigger control unit mating with one or more second physical features on the grip frame.

In some implementations, the one or more first physical features may include at least one laterally-protruding tab and the one or more second physical features may include at least one slot or indentation configured to mate with the at least one laterally-protruding tab when the trigger control unit is installed on the grip frame. Alternatively, the one or more second physical features may include at least one laterally-protruding tab and the one or more first physical features may include at least one slot or indentation configured to mate with the at least one laterally-protruding tab when the trigger control unit is installed on the grip frame.

In some implementations, in an event that at least the locking block pin is utilized to secure the trigger control unit to the grip frame, the locking block pin may traverse through a through hole on the flat wall extending from each slide rail of the pair of slide rails such that removal of the trigger control unit from the grip frame requires removal of the locking block pin.

In some implementations, an identification marking of the firearm may be displayed on the trigger mechanism housing and, when the trigger mechanism housing is received in the grip frame, may coincide with a centerline of a back side of the grip frame. Accordingly, when the trigger mechanism housing is received in the grip frame, the identification marking of the firearm may be visible through an opening on the back side of the grip frame.

In some implementations, when the trigger control unit is installed between the grip frame and the slide assembly, the slide assembly may be movable forwardly and rearwardly with respect to the grip frame on the slide rails. Additionally, the trigger control unit may be secured to the grip frame at least by the locking block pin and the trigger pin such that removal of the trigger control unit from the grip frame requires removal of the locking block pin and the trigger pin.

In some implementations, responsive to the trigger being pulled by the user when the trigger control unit is installed between the grip frame and the slide assembly, the trigger bar may cause a sear in the trigger mechanism housing to lower relative to the slide assembly such that the firing pin lug is released. Additionally, the trigger may be pivotably coupled to the first distal end of the support frame with the trigger pin traversing through the trigger and the first distal end of the support frame. Moreover, the trigger mechanism housing may be coupled to the second distal end of the support frame.

In some implementations, the trigger control unit may have a protruding tab protruding rearward with respect to the firearm and configured to be received in a recess on an interior wall of a beavertail portion of the grip frame. Accordingly, the trigger control unit may be secured to the grip frame at least by: (1) the protruding tab received in the recess on the interior wall of the beavertail portion of the grip frame; and (2) the locking block pin traversing through a through hole on flat wall extending from each slide rail of the pair of slide rails such that removal of the trigger control unit from the grip frame requires removal of the locking block pin.

In some implementations, the protruding tab may be formed by either or both of a portion of the support frame and a portion of the trigger mechanism housing.

In some implementations, the trigger mechanism housing may be configured to be removably received in each of a plurality of grip frames and installed between each of the plurality of grip frames and each of a plurality of slide assemblies such that: (a) at least two of the plurality of grip frames have different sizes, different colors, or different sizes and colors, or (b) at least two of the plurality of slide assemblies have different sizes, different colors, different calibers, or any combination thereof.

In some implementations, the apparatus may also include the grip frame. The grip frame may have an opening on the back side thereof and aligned with the identification marking of the firearm when the trigger mechanism housing is received in the grip frame such that the identification marking is visible through the opening. In some implementations, the apparatus may further include the slide assembly containing a striker-firing mechanism and longitudinally movable on the grip frame when the slide assembly is installed on the grip frame with the trigger mechanism housing installed between the slide assembly and the grip frame.

In yet another aspect, an apparatus (e.g., a semi-automatic or full-automatic firearm such as firearm 50) may include a trigger mechanism housing configured to be removably received in a grip frame of a firearm such that, when received in the grip frame, a serial number of the firearm displayed on the trigger mechanism housing may coincide with a centerline of a back side of the grip frame.

In some implementations, when the trigger mechanism housing is received in the grip frame, the serial number of the firearm may be visible through an opening on the back side of the grip frame. As the identification marking of the firearm is displayed on the trigger mechanism housing, under current United States laws and regulations, the trigger mechanism housing itself may be considered as a firearm.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. An apparatus, comprising:

a trigger control unit configured to be removably installed on a grip frame of a firearm, the trigger control unit comprising:

a locking block; and a pin configured to traverse through both the trigger control unit and the grip frame, wherein:

the trigger control unit has a protruding tab protruding rearward with respect to the firearm, the locking block comprises a pair of slide rails extending forward with respect to the firearm, with each slide rail of the pair of slide rails having a flat wall extending downward or upward with respect to the grip frame when the trigger control unit is installed on the grip frame, the trigger control unit is secured to the grip frame by:

the protruding tab received in a recess on an interior wall of a beavertail portion of the grip frame;

the pin; and one or more first physical features on the trigger control unit mating with one or more second physical features on the grip frame.

2. The apparatus of claim 1, wherein:

the one or more first physical features comprise at least one laterally-protruding tab and the one or more second physical features comprise at least one slot or indentation configured to mate with the at least one laterally-protruding tab when the trigger control unit is installed on the grip frame, or the one or more second physical features comprise at least one laterally-protruding tab and the one or more first physical features comprise at least one slot or indentation configured to mate with the at least one laterally-protruding tab when the trigger control unit is installed on the grip frame.

3. The apparatus of claim 1, wherein:

the trigger control unit further comprises a trigger mechanism housing configured to be removably received in the grip frame of the firearm, and when the trigger control unit is installed between the grip frame and a slide assembly of the firearm, the slide assembly is movable forwardly and rearwardly with respect to the grip frame on the slide rails.

4. The apparatus of claim 1, wherein the trigger control unit further comprises:

a trigger pin;

a trigger pivotable around the trigger pin when pulled;

a trigger bar coupled between the trigger and the trigger mechanism housing; and a support frame having a first distal end and a second distal end opposite the first distal end such that the first distal end faces a front side of the grip frame and the second distal end faces the back side of the grip frame when the trigger control unit is installed on the grip frame.

5. The apparatus of claim 4, wherein the pin comprises either or both of a locking block pin and the trigger pin, and wherein, in an event that at least the locking block pin is utilized to secure the trigger control unit to the grip frame, the locking block pin traverses through a through hole on the flat wall extending from each slide rail of the pair of slide rails such that removal of the trigger control unit from the grip frame requires removal of the locking block pin.

6. The apparatus of claim 4, wherein:

the trigger control unit is secured to the grip frame at least by the protruding tab, the locking block pin and the trigger pin such that removal of the trigger control unit from the grip frame requires removal of the locking block pin and the trigger pin, responsive to the trigger being pulled by the user when the trigger control unit is installed between the grip frame and the slide assembly, the trigger bar causes a sear in the trigger mechanism housing to lower relative to the slide assembly such that the firing pin lug is released, the trigger is pivotably coupled to the first distal end of the support frame with the trigger pin traversing through the trigger and the first distal end of the support frame, and the trigger mechanism housing is coupled to the second distal end of the support frame.

7. The apparatus of claim 4, wherein the support frame is made of a polymeric material, metal or a composite of metal and polymer.

8. The apparatus of claim 4, wherein the trigger mechanism housing is configured with a left indentation on a left side thereof and a right indentation on a right side thereof, wherein the support frame is configured with a left protrusion on a left inner surface near the second distal end and a right protrusion on a right inner surface near the second distal end, and wherein the support frame is coupled to the trigger mechanism housing by the left protrusion received in the left indentation and the right protrusion received in the right indentation.

9. The apparatus of claim 4, wherein the protruding tab is formed by either or both of a portion of the support frame and a portion of the trigger mechanism housing.

10. The apparatus of claim 1, wherein the trigger mechanism housing is configured to be removably received in each of a plurality of grip frames and installed between each of the plurality of grip frames and each of a plurality of slide assemblies such that:

at least two of the plurality of grip frames have different sizes, different colors, or different sizes and colors, or at least two of the plurality of slide assemblies have different sizes, different colors, different calibers, or any combination thereof.

11. The apparatus of claim 1, further comprising:

the grip frame having an opening on and along the centerline of the back side thereof and aligned with the identification marking of the firearm when the trigger mechanism housing is received in the grip frame such that the identification marking is visible through the opening; and a slide assembly containing a striker-firing mechanism and longitudinally movable on the grip frame when the slide assembly is installed on the grip frame with the trigger mechanism housing installed between the slide assembly and the grip frame.

12. An apparatus, comprising:

a trigger control unit configured to be removably received in a grip frame of a firearm and installed between the grip frame and a slide assembly of the firearm such that, when activated, the trigger control unit causes firing of one or more rounds of ammunition, the trigger control unit comprising:

a trigger mechanism housing;

a trigger pin;

a trigger pivotable around the trigger pin when pulled;

a trigger bar coupled between the trigger and the trigger mechanism housing;

a locking block;

a locking block pin; and a support frame having a first distal end and a second distal end opposite the first distal end such that the first distal end faces a front side of the grip frame and the second distal end faces a back side of the grip frame when the trigger control unit is installed on the grip frame, wherein:

the locking block comprises a pair of slide rails extending forward with respect to the trigger and the firearm, with each slide rail of the pair of slide rails having a flat wall extending downward or upward with respect to the grip frame when the trigger control unit is installed on the grip frame, and the trigger control unit is secured to the grip frame by:

either or both of the locking block pin and the trigger pin, and one or more first physical features on the trigger control unit mating with one or more second physical features on the grip frame.

13. The apparatus of claim 12, wherein:

the one or more first physical features comprise at least one laterally-protruding tab and the one or more second physical features comprise at least one slot or indentation configured to mate with the at least one laterally-protruding tab when the trigger control unit is installed on the grip frame, or the one or more second physical features comprise at least one laterally-protruding tab and the one or more first physical features comprise at least one slot or indentation configured to mate with the at least one laterally-protruding tab when the trigger control unit is installed on the grip frame.

14. The apparatus of claim 12, wherein, in an event that at least the locking block pin is utilized to secure the trigger control unit to the grip frame, the locking block pin traverses through a through hole on the flat wall extending from each slide rail of the pair of slide rails such that removal of the trigger control unit from the grip frame requires removal of the locking block pin.

15. The apparatus of claim 12, wherein:

when the trigger control unit is installed between the grip frame and the slide assembly, the slide assembly is movable forwardly and rearwardly with respect to the grip frame on the slide rails, and the trigger control unit is further secured to the grip frame at least by the locking block pin and the trigger pin such that removal of the trigger control unit from the grip frame requires removal of the locking block pin and the trigger pin.

16. The apparatus of claim 15, wherein:

responsive to the trigger being pulled by the user when the trigger control unit is installed between the grip frame and the slide assembly, the trigger bar causes a sear in the trigger mechanism housing to lower relative to the slide assembly such that the firing pin lug is released, the trigger is pivotably coupled to the first distal end of the support frame with the trigger pin traversing through the trigger and the first distal end of the support frame, and the trigger mechanism housing is coupled to the second distal end of the support frame.

17. The apparatus of claim 12, wherein the trigger control unit has a protruding tab protruding rearward with respect to the firearm and configured to be received in a recess on an interior wall of a beavertail portion of the grip frame, and wherein the trigger control unit is secured to the grip frame at least by:

the protruding tab received in the recess on the interior wall of the beavertail portion of the grip frame; and the locking block pin traversing through a through hole on flat wall extending from each slide rail of the pair of slide rails such that removal of the trigger control unit from the grip frame requires removal of the locking block pin.

18. The apparatus of claim 17, wherein the protruding tab is formed by either or both of a portion of the support frame and a portion of the trigger mechanism housing.

19. The apparatus of claim 12, wherein the trigger mechanism housing is configured to be removably received in each of a plurality of grip frames and installed between each of the plurality of grip frames and each of a plurality of slide assemblies such that:

at least two of the plurality of grip frames have different sizes, different colors, or different sizes and colors, or at least two of the plurality of slide assemblies have different sizes, different colors, different calibers, or any combination thereof.

20. The apparatus of claim 12, further comprising:

the grip frame having an opening on the back side thereof and aligned with the identification marking of the firearm when the trigger mechanism housing is received in the grip frame such that the identification marking is visible through the opening; and the slide assembly containing a striker-firing mechanism and longitudinally movable on the grip frame when the slide assembly is installed on the grip frame with the trigger mechanism housing installed between the slide assembly and the grip frame.

* * * * *